US010310426B2

(12) United States Patent
Maeyama

(10) Patent No.: US 10,310,426 B2
(45) Date of Patent: Jun. 4, 2019

(54) IMAGE FORMING APPARATUS HAVING SWITCHING CIRCUIT

(71) Applicant: KYOCERA Document Solutions Inc., Osaka (JP)

(72) Inventor: Keisuke Maeyama, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/020,192

(22) Filed: Jun. 27, 2018

(65) Prior Publication Data

US 2019/0004462 A1 Jan. 3, 2019

(30) Foreign Application Priority Data

Jun. 30, 2017 (JP) ..... 2017-129699

(51) Int. Cl.
*G03G 15/00* (2006.01)
*G03G 15/20* (2006.01)
*G03G 21/20* (2006.01)

(52) U.S. Cl.
CPC ..... *G03G 15/5004* (2013.01); *G03G 15/2039* (2013.01); *G03G 15/502* (2013.01); *G03G 21/203* (2013.01); *G03G 15/2053* (2013.01); *G03G 15/2064* (2013.01)

(58) Field of Classification Search
CPC ..... G03G 15/5004; G03G 15/5033; G03G 15/5045; G03G 21/20; G03G 21/203; G03G 21/206; G03G 2215/00084; G03G 2221/1645
USPC ..... 399/92, 94, 95, 96, 97
See application file for complete search history.

(56) References Cited

U.S. PATENT DOCUMENTS

2008/0247774 A1* 10/2008 Koga ..... G03G 21/203 399/13

FOREIGN PATENT DOCUMENTS

| | | | |
|---|---|---|---|
| JP | 9-269706 | | 10/1997 |
| JP | 2003098938 | A * | 4/2003 |
| JP | 2003287994 | A * | 10/2003 |
| JP | 2004144995 | A * | 5/2004 |
| JP | 2005321550 | A * | 11/2005 |
| JP | 2017075974 | A * | 4/2017 |

* cited by examiner

*Primary Examiner* — Robert B Beatty
(74) *Attorney, Agent, or Firm* — Wenderoth, Lind & Ponack, L.L.P.

(57) ABSTRACT

An image forming apparatus has a power supply circuit including a power circuit, a main circuit, and a sub-circuit. The sub-circuit includes a timer that performs electrical conduction of a driving contact point of a heater by a first setting time and performs electrical conduction of a driving contact point of a discharge fan by a second setting time when a power switch is turned off. When it is determined that humidity in an image forming apparatus body detected by a humidity detection sensor is equal to or more than a threshold value, the first setting time is set to 0 and the second setting time is set to a predetermined time larger than 0. When it is determined that the humidity is less than the threshold value, the first setting time is set to a predetermined time larger than 0 and the second setting time is set to 0.

5 Claims, 4 Drawing Sheets

IMAGE FORMING APPARATUS HAVING SWITCHING CIRCUIT

CROSS-REFERENCE TO RELATED APPLICATION

This application is based upon and claims the benefit of priority from Japanese Patent Application No. 2017-129699 filed on Jun. 30, 2017, the entire contents of which are incorporated herein by reference.

BACKGROUND

The technology of the present disclosure relates to an image forming apparatus.

In an electrophotographic image forming apparatus, there are some cases where a heater is disposed in the image forming apparatus in order to prevent dew condensation of a photosensitive drum or an exposing device. The heater is provided to machine parts, such as the photosensitive drum and an optical device, in which dew condensation easily occurs.

A power supply circuit of the image forming apparatus is connected to either a load system circuit, which supplies power to an image forming apparatus body, or a heat system circuit, which supplies power to the heater, via a changeover switch. The changeover switch can be switched interlocking with a power switch of the image forming apparatus. The changeover switch connects the power supply circuit to a main circuit when the power switch is in an ON state, and connects the power supply circuit to the heat system circuit when the switch is in an OFF state. The power supply circuit is provided with a timer. The timer operates the heater by closing a contact point provided to the heat system circuit when a preset time has come.

SUMMARY

An image forming apparatus according to one aspect of the present disclosure includes an image forming apparatus body, a power switch, a control unit, and a power supply circuit. The control unit controls an image forming operation in a state in which the power switch is turned on. The power supply circuit supplies power to the control unit.

The image forming apparatus further includes a heater, a discharge device, and a humidity detection sensor. The heater heats a predetermined place in the image forming apparatus body. The discharge device discharges water vapor in the image forming apparatus body to an exterior. The humidity detection sensor detects humidity in the aforementioned image forming apparatus body or humidity associated with the humidity and transmits information on the detected humidity to the aforementioned control unit.

The power supply circuit includes a power circuit connected to a power supply, a main circuit including the control unit, a sub-circuit including the discharge device and the heater, and a switching circuit. The switching circuit connects the power circuit to the main circuit when the power switch is turned on and connects the power circuit to the sub-circuit when the power switch is turned off.

The sub-circuit includes a driving contact point of the heater, a driving contact point of the discharge device, and a timer. The timer performs electrical conduction of the driving contact point of the heater for a first setting time and performs electrical conduction of the driving contact point of the discharge device for a second setting time when the power switch is turned off.

The control unit performs timer setting control for determining whether the humidity in the image forming apparatus body is equal to or more than a threshold value on the basis of humidity information received from the humidity detection sensor, for setting the first setting time in the timer to 0 while setting the second setting time to a predetermined time larger than 0 when it is determined that the humidity is equal to or more than the threshold value, and for setting the first setting time in the timer to a predetermined time larger than 0 while setting the second setting time to 0 when it is determined that the humidity is less than the threshold value, in a state in which the power switch is turned on.

DETAILED DESCRIPTION

Hereinafter, examples of embodiments will be described in detail with reference to the drawings. It is noted that the technical scope of the present disclosure is not limited to the following embodiments.

Embodiment 1

Figure 1:
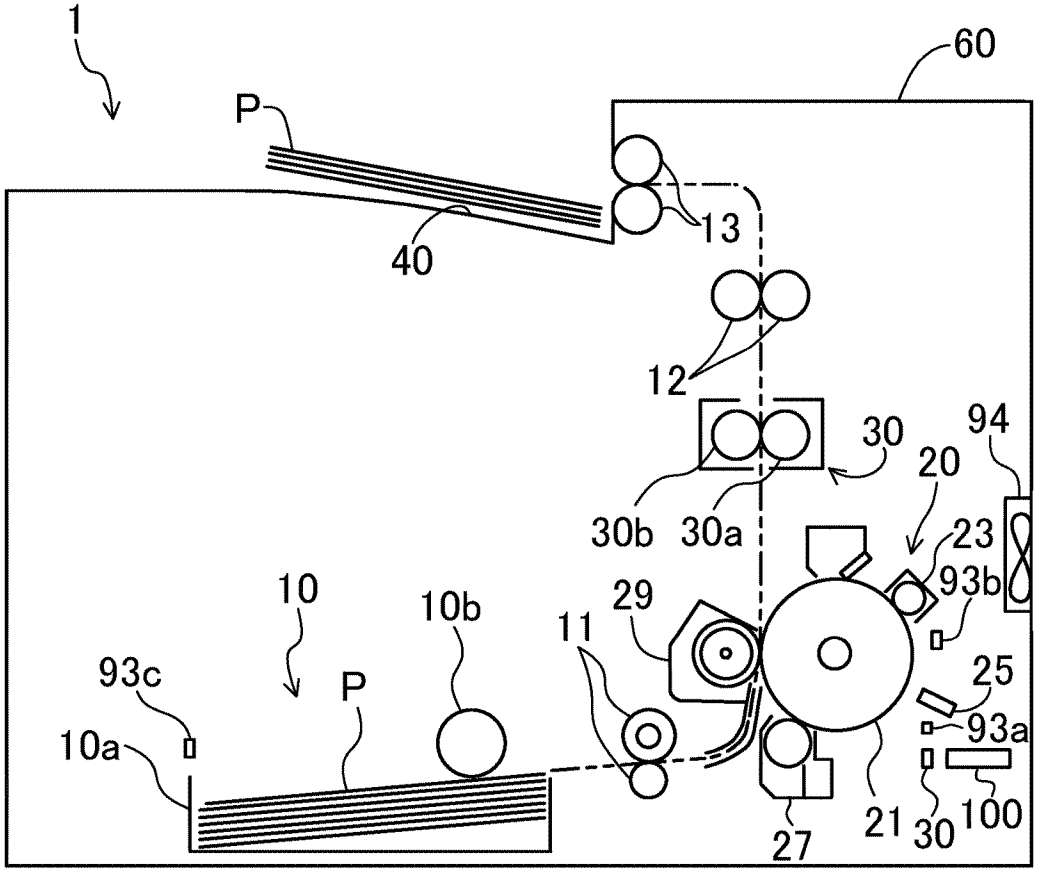
FIG. 1 is a schematic view illustrating an image forming apparatus in an embodiment.

FIG. 1 is a schematic view illustrating an image forming apparatus 1 in the present embodiment. The image forming apparatus 1 is a laser printer and includes a sheet feeding unit 10, an image forming unit 20, a fixing unit 30, and a sheet discharge unit 40. The sheet feeding unit 10 is provided at a lower part of an image forming apparatus body 60, the sheet discharge unit 40 is provided on an upper surface of the image forming apparatus body 60, and the image forming unit 20 and the fixing unit 30 are provided in the middle of a sheet conveyance path from the sheet feeding unit 10 to the sheet discharge unit 40. Furthermore, the image forming apparatus body 60 is provided therein with a plurality of conveying roller pairs 11 to 13 along the sheet conveyance path.

The sheet feeding unit 10 has a sheet feeding cassette 10*a* in which sheets P are received, and a pick-up roller 10*b* for taking out the sheets P in the sheet feeding cassette 10*a* and sending the sheets P out of the cassette. The sheets P sent out of the cassette by the sheet feeding cassette 10*a* are supplied to the image forming unit 20 via the conveying roller pair 11.

The image forming unit 20 has a photosensitive drum 21, a charging device 23, an exposing device 25, a developing device 27, and a transfer unit 29. At the time of image formation, a peripheral surface of the photosensitive drum 21 is first charged by the charging device 23, and then laser light based on document image data (for example, image data of a document image received from an external terminal) is irradiated to the surface of the photosensitive drum 21 by the exposing device 25. By so doing, on the surface of the photosensitive drum 21, an electrostatic latent image corresponding to the aforementioned image data is formed. The electrostatic latent image formed on the surface of the photosensitive drum 21 is developed by the developing device 27 as a toner image. In this way, the toner image is formed (carried) on the surface of the photosensitive drum 21. The toner image is transferred to the sheet P, which is supplied from the sheet feeding unit 10, by the transfer unit 29. The sheet P with the transferred toner image is supplied to the fixing unit 30 by the rotation of a transfer roller in the transfer unit 29.

The fixing unit 30 heats and presses the sheet P supplied from the transfer unit 29 between a fixing roller 30*a* and a pressure roller 30*b*, thereby fixing the toner image to the sheet P. Then, the sheet P with the toner image fixed by the fixing unit 30 is sent to a downstream side in a sheet conveyance direction by the rollers 30*a* and 30*b*. The sheet P sent from the fixing unit 30 is discharged to the sheet discharge unit 40 via the plurality of conveying roller pairs 12 and 13.

The image forming apparatus body 60 is provided therein with an optical condensation heater 93*a*, a drum heater 93*b*, and a cassette heater 93*c*. The optical condensation heater 93*a*, the drum heater 93*b*, and the cassette heater 93*c* are respectively provided in the vicinity of the exposing device 25, the photosensitive drum 21, and the sheet feeding cassette 10*a*. The optical condensation heater 93*a* prevents dew condensation from occurring in an optical element (a mirror, a lens and the like) in the exposing device 25. The drum heater 93*b* prevents the occurrence of image defects and jam due to sheet winding by maintaining the temperature of the photosensitive drum 21 and preventing dew condensation of the photosensitive drum 21. The cassette heater 93*c* prevents the occurrence of paper jam from occurring when dew condensation occurs in the sheet feeding cassette 10*a* of the sheet feeding unit 10 and thus the sheet P becomes wet. These heaters 93*a* to 93*c* prevent dew condensation by raising the temperature of air and thus increasing the amount of saturated water vapor.

The image forming apparatus body 60 is further provided with a discharge fan (a discharge device) 94 for preventing dew condensation. The discharge fan 94 is provided to a sidewall adjacent to the image forming unit 20 in the image forming apparatus body 60. The discharge fan 94 discharges air including water vapor in the image forming apparatus body 60 to an exterior, thereby reducing the amount of water vapor in the image forming apparatus body 60 and thus preventing the occurrence of dew condensation.

Figure 2:
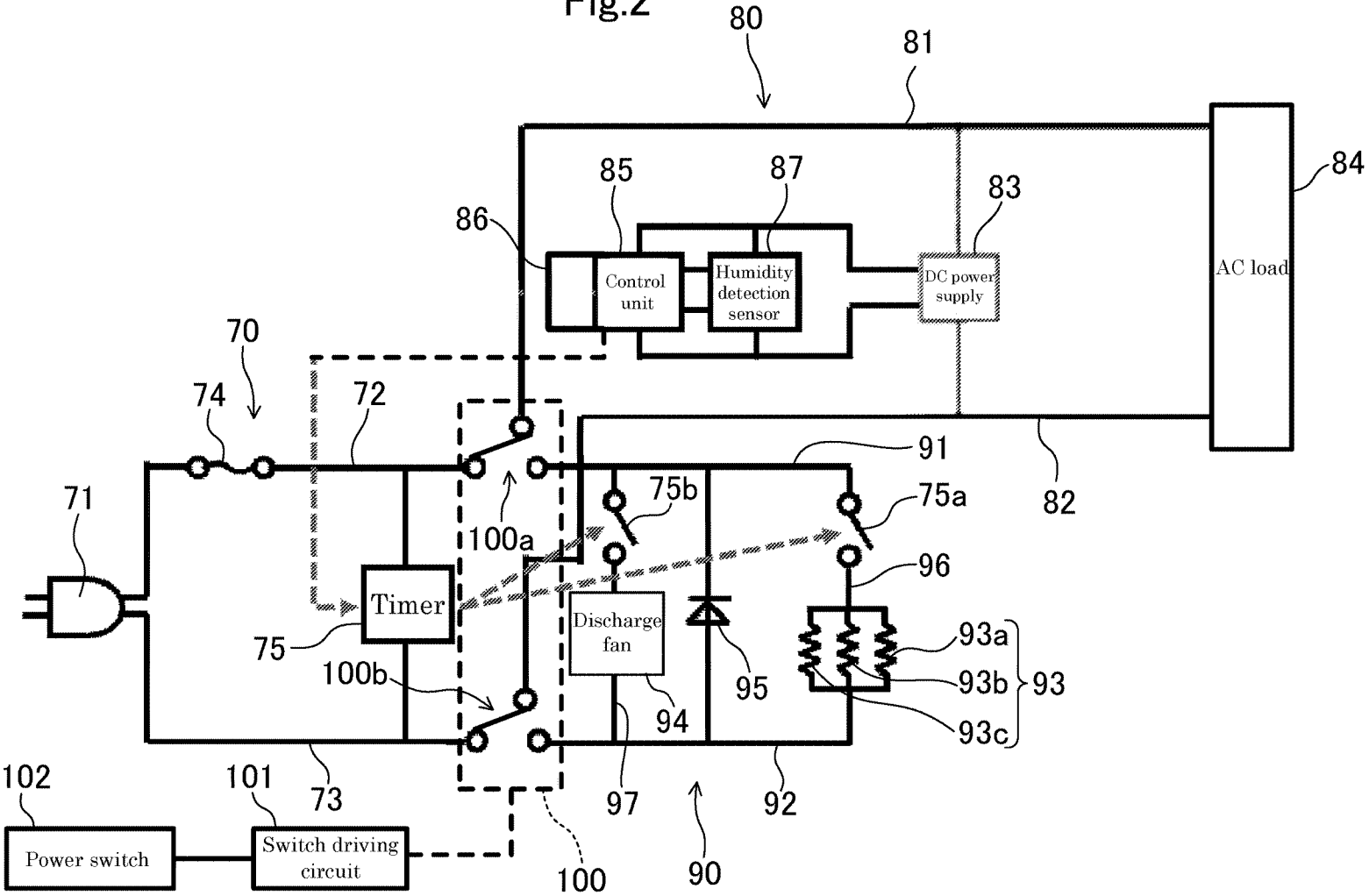
FIG. 2 is a circuit diagram illustrating an example of a power supply circuit that supplies power to each element of an image forming apparatus.

Next, with reference to FIG. 2, a power supply circuit that supplies power to each element of the image forming apparatus 1 will be described. The power supply circuit has a power circuit 70, a main circuit 80, a sub-circuit 90, and a switching circuit 100.

The power circuit 70 includes a power plug 71 which is connected to an outlet of an AC power supply. Two power supply lines of a hot line 72 and a neutral line 73 are connected to the power plug 71. A fuse 74 is serially connected to the hot line 72. A timer 75 is connected between the hot line 72 and the neutral line 73.

Changeover switches 100*a* and 100*b* are respectively connected to one end of the hot line 72 and one end of the neutral line 73 of the power circuit 70. The changeover switches 100*a* and 100*b* constitute a part of the changeover switch 100.

The changeover switches 100*a* and 100*b* are driven by a switch driving circuit 101 to switch a connection destination (the power supply destination) of the power circuit 70 to either the main circuit 80 or the sub-circuit 90. FIG. 2 illustrates a state in which the power circuit 70 is connected to the main circuit 80 by the changeover switches 100*a* and 100*b* (corresponding to a first state in which the power circuit 70 supplies power to the main circuit 80). When the changeover switches 100*a* and 100*b* are switched to an opposite side of the state illustrated in FIG. 2 by the switch driving circuit 101, the power circuit 70 is connected to the sub-circuit 90 and the connection between the power circuit 70 while the main circuit 80 is disconnected (corresponding to a second state in which the power circuit 70 supplies power to the sub-circuit 90).

The switch driving circuit 101 is connected to a power switch 102 provided to an operation unit of the image forming apparatus body 60. When a signal indicating the turning-on of the power switch 102 is received, the switch driving circuit 101 switches the changeover switches 100*a* and 100*b* to the main circuit 80 side as illustrated in FIG. 2. On the other hand, when a signal indicating the turning-off of the power switch 102 is received, the switch driving circuit 101 switches the changeover switches 100*a* and 100*b* to the sub-circuit 90 side.

The main circuit 80 includes a hot line 81, a neutral line 82, a DC power supply 83, and an AC load 84. The hot line 81 is connected to the hot line 72 of the power circuit 70 via the changeover switch 100*a* so as to be electrically connectable/disconnectable, and the neutral line 82 is connected to the neutral line 73 of the power circuit 70 via the changeover switch 100*b* so as to be electrically connectable/disconnectable. The DC power supply 83 and the AC load 84 are connected between the hot line 81 and the neutral line 82. A control unit 85 is connected to the DC power supply 83 to control an image forming operation which is performed by the image forming apparatus 1.

The control unit 85, for example, is configured by a microcomputer including a CPU, a ROM, a RAM and the like. A DC load and various sensors are connected to the control unit 85. FIG. 2 illustrates only a humidity detection sensor 87, which measures humidity in the image forming apparatus body 60, as an example of the sensor.

The sub-circuit 90 includes a hot line 91, a neutral line 92, the three heaters 93*a* to 93*c*, and the discharge fan 94. The hot line 91 is connected to the hot line 72 of the power circuit 70 via the changeover switch 100*a* so as to be electrically connectable/disconnectable, and the neutral line 92 is connected to the neutral line 73 of the power circuit 70 via the changeover switch 100*b* so as to be electrically connectable/disconnectable. The three heaters 93*a* to 93*c* are disposed in parallel to one another and are connected to a first line 96 across between the hot line 91 and the neutral line 92. The discharge fan 94 is connected to a second line 97 across between the hot line 91 and the neutral line 92. A reference number 95 of the drawing indicates a diode for counter electromotive voltage protection, which is disposed in parallel to the discharge fan 94.

The first line 96 and second line 97 are respectively provided with contact points A (75*a* and 75*b*) which are driven by the timer 75. In a state in which the power circuit 70 has been connected to the sub-circuit 90, when the A (75*a* and 75*b*) are closed, the heaters 93*a* to 93*c* and the discharge fan 94, which are disposed on the first line 96 and second line 97, operate. The two contact points A (75*a* and 75*b*) can be driven by the timer 75 independently from each other. Consequently, it is possible to operate the heaters 93*a* to 93*c* and the discharge fan 94 independently from each other in accordance with setting content of the timer 75. In the following description, the contact point A (75*a*) provided on the first line 96 will be referred to as a heater driving contact point, and the contact point A (75*b*) provided on the second line 97 will be referred to as a fan driving contact point.

The timer 75 is connected to the control unit 85 so as to be able to transmit and receive signals. The timer 75 stores an ON time (a conduction time) of the heater driving contact point 75*a* as a first setting time T1, and stores an ON time of the fan driving contact point 75*b* as a second setting time T2. The setting times T1 and T2 stored in the timer 75 are set by the control unit 85. The control unit 85 updates (sets) the setting times T1 and T2 at predetermined time intervals in accordance with humidity detected by the humidity detection sensor 87 as will be described later.

Figure 3:
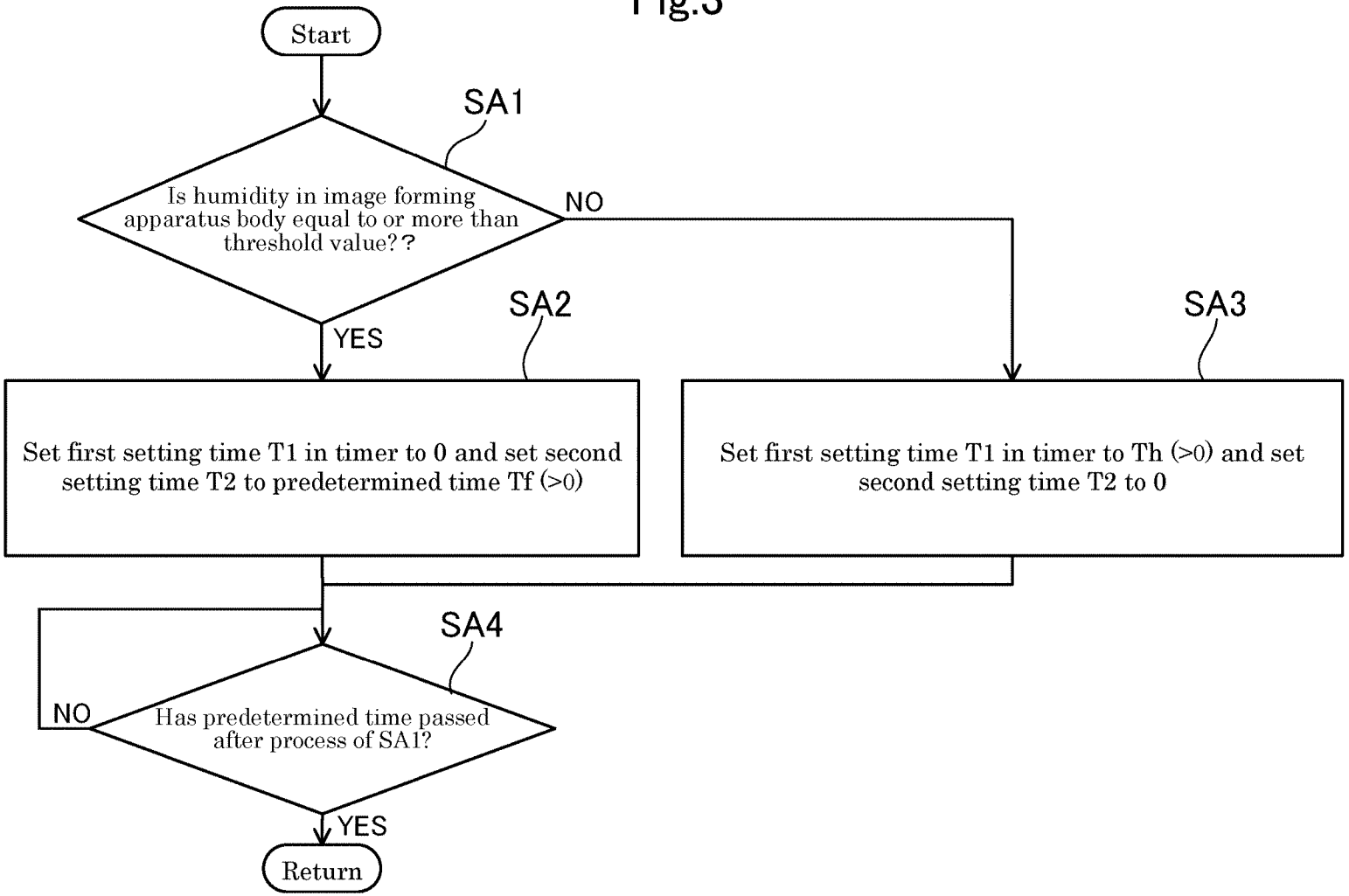
FIG. 3 is a flowchart illustrating content of dew condensation prevention control in a control unit.

With reference to FIG. 3, details of the setting control of the first and second setting times T1 and T2 by the control unit 85 will be described.

In step SA1, the control unit 85 calculates humidity in the image forming apparatus body 60 on the basis of a detection signal (humidity information) of the humidity detection sensor 87, and determines whether the calculated humidity is equal to or more than a threshold value set in advance. When the determination is NO, the control unit 85 proceeds to step SA3, and when the determination is YES, the control unit 85 proceeds to step SA2.

In step SA2, the control unit 85 sets the first setting time T1, which is the ON time of the heater driving contact point 75*a* stored in the timer 75, to 0, sets the second setting time T2, which is the ON time of the fan driving contact point 75*b*, to a predetermined time Tf larger than 0, and then proceeds to step SA4. The predetermined time Tf is preferably a sufficient time capable of lowering the humidity in the image forming apparatus body 60 to be less than the threshold value, and for example, is set to 30 minutes to one hour. The predetermined time Tf may be a constant value or may be longer as the humidity detected by the humidity detection sensor 87 is higher.

In step SA3 performed when the determination of step SA1 is NO, the control unit 85 sets the first setting time T1, which is the ON time of the heater driving contact point 75*a* stored in the timer 75, to a predetermined time Th larger than 0, sets the second setting time T2, which is the ON time of the fan driving contact point 75*b*, to 0, and then proceeds to step SA4. The predetermined time Th is preferably an average value of times from an OFF operation of the power switch 102 of the image forming apparatus 1 to an ON operation of the power switch 102. It is sufficient if the average value is calculated by the control unit 85. The predetermined time Th may not be based on such an average value and may be set by predicting an OFF time of the power switch 102 of the image forming apparatus 1. That is, for example, when it is assumed that the power switch 102 of the image forming apparatus 1 is in an OFF state from 9:00 PM to 9:00 AM of the following day, it is sufficient if the predetermined time Th is set to 12 hours. The predetermined time Th is sufficiently longer than the predetermined time Tf described in the step SA2.

In step SA4, the control unit 85 determines whether a predetermined time (for example, 10 minutes) has passed after the determination process of step SA1 is performed. When the determination is NO, the control unit 85 performs the process of the present step SA4 again, and when the determination is YES, the control unit 85 returns.

In the image forming apparatus 1 configured as above, when the power switch 102 is turned on, the power circuit 70 is connected to the main circuit 80 via the changeover switches 100*a* and 100*b*. Then, power is supplied to each element of the image forming apparatus 1 and a print process and the like are performed, so that temperature in the image forming apparatus body 60 rises. When the temperature in the image forming apparatus body 60 is high, dew condensation does not occur, but when the power switch 102 is turned off and the temperature in the image forming apparatus body 60 is reduced, dew condensation may occur.

In order to solve the problem, in the conventional image forming apparatus, a heater is disposed at a place where image defects or failure of the apparatus may occur due to the occurrence of dew condensation, and is operated even after a power switch is turned off to maintain the amount of saturated water vapor in the air to be high, thereby preventing the occurrence of the dew condensation. However, in a case where humidity in the image forming apparatus is high, since the amount of water vapor in the air is large, it is not possible to completely suppress the occurrence of the dew condensation even after the heater is operated. In this regard, it is considered to suppress the occurrence of the dew condensation by reducing the amount of water vapor in the image forming apparatus. As a method for reducing the amount of water vapor, there is a method for forcibly discharging air including water vapor in the image forming apparatus out of the apparatus by a discharge fan. However, power for generally driving the discharge fan is considerably larger than power for driving the heater. Consequently, when the discharge fan is simply operated, there is a problem that an energy saving property is reduced.

However, in the present embodiment, in a state in which the power switch 102 is turned on, the control unit 85 determines whether humidity in the image forming apparatus body 60 is equal to or more than a threshold value on the basis of humidity information received from the humidity detection sensor 87. When it is determined that the humidity is equal to or more than the threshold value, the control unit 85 is configured to set the first setting time T1 (the ON time of the heater driving contact point 75*a*) in the timer 75, to 0 and set the second setting time T2 (the ON time of the fan driving contact point 75*b*) to the predetermined time Tf larger than 0. However, when it is determined that the aforementioned humidity is less than the aforementioned threshold value, the control unit 85 is configured to set the aforementioned first setting time in the timer 75, to the predetermined time Th larger than 0 and set the aforementioned second setting time to 0.

According to the configuration, when the humidity in the image forming apparatus body 60 is equal to or more than the threshold value, after the power switch 102 is turned off, since the discharge fan 94 is driven by the timer 75 during only the predetermined time Tf (=the second setting time), the heaters 93*a* to 93*c* do not operate.

Consequently, when the humidity in the image forming apparatus body 60 is high (when the amount of water vapor is large), the discharge fan 94 capable of reducing the amount of water vapor is operated, so that it is possible to reliably suppress the occurrence of dew condensation.

On the other hand, when the humidity in the image forming apparatus body 60 is less than the threshold value, after the power switch 102 is turned off, since the heaters 93*a* to 93*c* are driven by the timer 75 during only the predetermined time (=the first setting time T1), the discharge fan 94 does not operate.

Consequently, when the humidity in the image forming apparatus body 60 is low, since the amount of water vapor in the air is small, the discharge fan 94 is not operated and the heaters 93*a* to 93*c* consuming low power are operated, so that it is possible to prevent the occurrence of dew condensation.

Thus, in the present embodiment, it is possible to reliably prevent dew condensation from occurring in the image forming apparatus body 60 after the power switch 102 is turned off without reducing an energy saving property. Furthermore, it is possible to prevent operation noise of the discharge fan 94 from being unnecessarily generated.

Furthermore, in the present embodiment, the control unit 85 is configured to perform timer setting control (the processes of steps SA1 to SA3) at predetermined time intervals.

In this way, it is possible to set the setting times T1 and T2 of the timer 75 by maximally reflecting humidity in the image forming apparatus body 60 at a current time point.

Embodiment 2

Figure 4:
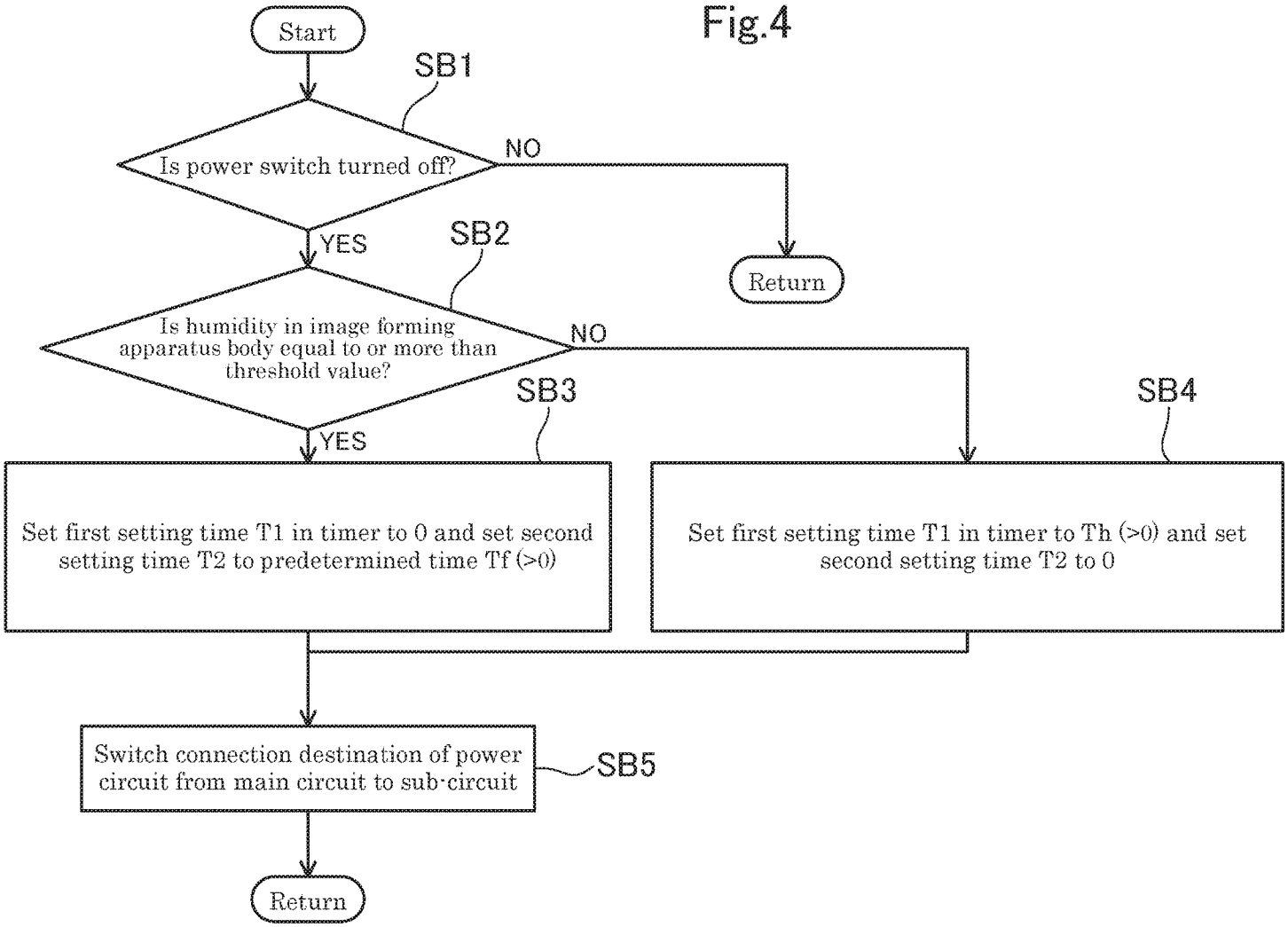
FIG. 4 is a diagram corresponding to FIG. 3, which illustrates an embodiment 2.

FIG. 4 illustrates an embodiment 2. In the present embodiment, setting timings of the setting times T1 and T2 of the timer 75 by the control unit 85 are different from those of the embodiment 1. That is, in the present embodiment, the setting times T1 and T2 of the timer 75 are set only immediately after the power switch 102 is turned off.

Specifically, in step SB1, on the basis of an operation signal of the power switch 102, the control unit 85 determines whether the power switch 102 is turned off. When the determination is NO, the control unit 85 returns without setting the setting times T1 and T2 of the timer 75, and when the determination is YES, the control unit 85 proceeds to step SB2.

Processes of steps SB2 to SB4 are similar to those of steps SA1 to SA3 in the embodiment 1.

In step SB5, the control unit 85 drives the changeover switches 100*a* and 100*b* (the switching circuit 100) by the switch driving circuit 101 to switch a connection destination of the power circuit 70 from the main circuit 80 to the sub-circuit 90, and then returns.

According to the configuration, in the present embodiment, immediately after the power switch 102 is turned off and before a connection destination of the power switch 102 is switched from the main circuit 80 to the sub-circuit 90 by the switching circuit 100, timer setting control (steps SB2 to SB4) is performed. Consequently, as compared with the case where the setting times T1 and T2 of the timer 75 are set at predetermined time intervals during the operation of the image forming apparatus 1, it is possible to reduce an arithmetic load of the control unit 85.

Furthermore, humidity in the image forming apparatus body 60 is measured by the humidity detection sensor 87 at the nearest time at which the heaters 93*a* to 93*c* or the discharge fan 94 is operated, so that it is possible to set the setting times T1 and T2 of the timer 75 by maximally reflecting humidity in the image forming apparatus body 60 at a current time point.

Other Embodiments

In the aforementioned each embodiment, humidity in the image forming apparatus body 60 is detected by the humidity detection sensor 87; however, the technology of the present disclosure is not limited thereto. For example, the humidity detection sensor 87 may be allowed to detect humidity of an interior in which the image forming apparatus body 60 is installed. That is, it is sufficient if humidity detected by the humidity detection sensor 87 is humidity correlated (that is, associated) with humidity in the image forming apparatus body 60.

Furthermore, in the aforementioned each embodiment, even when it is determined that humidity in the image forming apparatus body 60 is equal to or more than the threshold value, when a silent mode (a mode for prioritizing suppression of noise) is set, the first setting time (the ON time of the heater driving contact point 75*a*) in the timer 75 may be set to the predetermined time Th larger than 0 and the second setting time (the ON time of the fan driving contact point 75*b*) may be set to 0. In this way, it is possible to prevent silence performance from being impaired due to the operation of the discharge fan 94 even when a user has set an operation mode of the image forming apparatus 1 as a silent mode.

Furthermore, in the aforementioned each embodiment, the discharge fan 94 is used as a discharge device for discharging water vapor in the image forming apparatus body 60 to an exterior; however, the technology of the present disclosure is not limited thereto and for example, a heat exchanger may be used.

It should be noted that the technical scope of the present disclosure is not limited to the aforementioned each embodiment and includes configurations obtained by appropriately combining the embodiments with each other.

What is claimed is:

1. An image forming apparatus including an image forming apparatus body, a control unit for controlling an image forming operation, a power supply circuit for supplying power to the control unit, and a power switch for switching a state of the power supply circuit, the image forming apparatus further comprising:

a heater that heats a predetermined place in the image forming apparatus body;

a discharge device that discharges water vapor in the image forming apparatus body to an exterior; and a humidity detection sensor that detects humidity in the image forming apparatus body, and transmits information on the detected humidity to the control unit, wherein the power supply circuit comprises:

a power circuit connected to a power supply;

a main circuit including the control unit;

a sub-circuit including the discharge device and the heater; and a switching circuit that switches a first state in which the power circuit supplies power to the main circuit, and a second state in which the power circuit supplies power to the sub-circuit, the switching circuit is configured to switch the power supply circuit to the first state when the power switch is turned on, and switch the power supply circuit to the second state when the power switch is turned off, the sub-circuit comprises:

a driving contact point of the heater; and a driving contact point of the discharge device;

the power circuit comprises: a timer that carries out contact point driving control for performing electrical conduction of the driving contact point of the heater for a first setting time and performing electrical conduction of the driving contact point of the discharge device for a second setting time when the power supply circuit is switched from the first state to the second state, the control unit is configured to perform timer setting control for determining whether the humidity in the image forming apparatus body is equal to or more than a threshold value on the basis of humidity information received from the humidity detection sensor, for setting the first setting time in the timer to 0 while setting the second setting time to a predetermined time larger than 0 when it is determined that the humidity is equal to or more than the threshold value, and for setting the first setting time in the timer to a predetermined time larger than 0 while setting the second setting time to 0 when it is determined that the humidity is less than the threshold value, in a state in which the power supply circuit is switched to the first state by the switching circuit, and the timer is configured to perform the contact point driving control based on the first setting time and the second setting time set by the timer setting control in the control unit before the switching when the power supply circuit is switched from the first state to the second state.

2. The image forming apparatus of claim 1, wherein the control unit is configured to perform the timer setting control at a predetermined time interval.

3. The image forming apparatus of claim 1, wherein the timer is connected to the control unit so as to be able to transmit and receive signals, and store the first setting time and the second setting time that are set by the control unit so as to perform the contact point driving control based on the first setting time and the second setting time.

4. An image forming apparatus including an image forming apparatus body, a control unit for controlling an image forming operation in a state in which the power switch is turned on, a power supply circuit for supplying power to the control unit, and a power switch for switching a state of the power supply circuit, the image forming apparatus further comprising:

a heater that heats a predetermined place in the image forming apparatus body;

a discharge device that discharges water vapor in the image forming apparatus body to an exterior; and a humidity detection sensor that detects humidity in the image forming apparatus body, and transmits information on the detected humidity to the control unit, wherein the power supply circuit comprises:

a power circuit connected to a power supply;

a main circuit including the control unit;

a sub-circuit including the discharge device and the heater; and a switching circuit that switches a first state in which the power circuit supplies power to the main circuit, and a second state in which the power circuit supplies power to the sub-circuit, the switching circuit is configured to switch the power supply circuit to the first state when the power switch is turned on, and switch the power supply circuit to the second state when the power switch is turned off, the sub-circuit comprises:

a driving contact point of the heater; and a driving contact point of the discharge device;

the power circuit comprises: a timer that carries out contact point driving control for performing electrical conduction of the driving contact point of the heater for a first setting time and performing electrical conduction of the driving contact point of the discharge device for a second setting time when the power supply circuit is switched from the first state to the second state, the control unit is configured to perform timer setting control for determining whether the humidity in the image forming apparatus body is equal to or more than a threshold value on the basis of humidity information received from the humidity detection sensor, for setting the first setting time in the timer to 0 while setting the second setting time to a predetermined time larger than 0 when it is determined that the humidity is equal to or more than the threshold value, and for setting the first setting time in the timer to a predetermined time larger than 0 while setting the second setting time to 0 when it is determined that the humidity is less than the threshold value, immediately after the power switch is turned off and before the power supply circuit is switched from the first state to the second state by the switching circuit, and the timer is configured to perform the contact point driving control based on the first setting time and the second setting time set by the timer setting control in the control unit before switching when the power supply circuit is switched from the first state to the second state.

5. The image forming apparatus of claim 4, wherein the timer is connected to the control unit so as to be able to transmit and receive signals, and store the first setting time and the second setting time that are set by the control unit so as to perform the contact point driving control based on the first setting time and the second setting time.

* * * * *